US010032398B2

(12) United States Patent
Gray

(10) Patent No.: US 10,032,398 B2
(45) Date of Patent: Jul. 24, 2018

(54) PATIENT IDENTIFYING GARMENT AND METHOD

(71) Applicant: Cathy Gray, Mooresville, IN (US)

(72) Inventor: Cathy Gray, Mooresville, IN (US)

( * ) Notice: Subject to any disclaimer, the term of this patent is extended or adjusted under 35 U.S.C. 154(b) by 67 days.

(21) Appl. No.: 14/793,380

(22) Filed: Jul. 7, 2015

(65) Prior Publication Data

US 2016/0005340 A1 Jan. 7, 2016

Related U.S. Application Data

(60) Provisional application No. 62/021,349, filed on Jul. 7, 2014.

(51) Int. Cl.

| | |
|---|---|
| ***A41B 9/00*** | (2006.01) |
| ***G09F 21/02*** | (2006.01) |
| ***A41D 13/12*** | (2006.01) |
| *G09F 3/02* | (2006.01) |

(52) U.S. Cl.
CPC ..... *G09F 21/026* (2013.01); *A41D 13/1281* (2013.01); *G09F 2003/0282* (2013.01)

(58) Field of Classification Search
CPC ..... A41D 13/1236; A41D 13/1245; A41D 13/1254; A41D 13/129; A41D 2300/33; A41D 2300/50
USPC ..... 2/114, 48–49; 40/745; 29/428
See application file for complete search history.

(56) References Cited

U.S. PATENT DOCUMENTS

| | | | | |
|---|---|---|---|---|
| 2,091,083 | A | 8/1937 | Polikoff | |
| 2,244,656 | A | 6/1941 | Asch | |
| 2,440,666 | A | 4/1948 | Neely | |
| 2,556,039 | A * | 6/1951 | Landert | A41D 1/18 2/106 |
| 5,075,897 | A * | 12/1991 | Daniels | A41D 13/04 108/43 |
| 5,082,289 | A * | 1/1992 | Paranto | A63B 67/002 2/52 |
| 6,032,287 | A * | 3/2000 | Kallas | A41B 13/10 2/69 |
| 7,032,247 | B2 * | 4/2006 | Frieswick | A41B 13/10 2/49.1 |
| 7,865,971 | B1 | 1/2011 | Kileb | |
| 2012/0137399 | A1 * | 6/2012 | Forte | A47G 1/0616 2/69 |
| 2012/0278967 | A1 | 11/2012 | Huff | |
| 2014/0310850 | A1 * | 10/2014 | Hudak | A41D 13/1245 2/114 |

* cited by examiner

*Primary Examiner* — Khaled Annis
*Assistant Examiner* — Timothy K Trieu
(74) *Attorney, Agent, or Firm* — Maginot, Moore & Beck LLP

(57) ABSTRACT

A patient identifying garment includes a flexible sheet having a visible indicator. The flexible sheet has a first lateral edge, a second lateral edge, an upper portion and a lower portion. The width of the flexible sheet exceeds the diameter of an adult human neck. At least two straps extend from the upper portion of the flexible sheet, each strap having at least one hole therethrough. Each hole is adapted to be secured between a plurality of fasteners on a shoulder portion of a hospital gown.

20 Claims, 5 Drawing Sheets

PATIENT IDENTIFYING GARMENT AND METHOD

CROSS-REFERENCE TO RELATED APPLICATIONS

This document claims priority to U.S. Provisional Patent Application No. 62/021,349, filed Jul. 7, 2014, the contents of which are incorporated herein by reference in their entirety.

FIELD

This document relates to the field of health care, and particularly to garments for use in hospitals and other medical facilities.

BACKGROUND

It is a common practice of hospitals to identify patients who are at risk of falling, either while in bed or while moving. Patients who do fall can exacerbate preexisting conditions or sustain new injuries altogether, thus extending the length of their hospital stay. In order to deal with this problem, hospitals often mark such patients with a colored bracelet, colored socks, or a colored blanket so that healthcare professionals are made aware of the falling risk. However, wristbands and socks can be difficult to see, and blankets are only effective when the patient is in their bed.

Known devices that relate to garments that may be worn around an individual's neck typically consist of cloth bibs that are disposed on the front of the user and have straps extending around the neck of the individual that can be removably and adjustably secured together. However, these devices do not provide means for clearly identifying individuals or a means of securing the garment directly to a hospital gown. Moreover, these devices may actually endanger certain patients because they wrap around the neck and are fastened at the back of the neck.

Accordingly, there is a need for a patient identifying garment that is easily visible and thus makes patients who are at risk of falling quickly identifiable. Furthermore, there is a need for such a garment to be safely, easily and comfortably secured to an individual.

SUMMARY

In accordance with one exemplary embodiment of the disclosure, there is provided an easily visible patient identifying garment that can be secured to the snaps or other fasteners of a hospital gown. The identifying garment includes a flexible sheet having a visible indicator. The flexible sheet has a first lateral edge, a second lateral edge, an upper edge and a lower edge. The width of the flexible sheet exceeds the diameter of an adult human neck. At least two straps extend from the upper portion of the flexible sheet, each strap having at least one hole therethrough. Each hole is adapted to be secured between a plurality of fasteners on a shoulder portion of a hospital gown. In the exemplary embodiment described below, the flexible sheet is of a general rectangular shape, and the visible indicator is a solid color, such as a yellow color. Furthermore, the upper portion may have a central concave edge portion outlining a human neck disposed between first and second top edge portions. The identifying garment may have third and fourth straps as well, disposed adjacent to the first and second straps.

The above described features and advantages, as well as others, will become more readily apparent to those of ordinary skill in the art by reference to the following detailed description and accompanying drawings. While it would be desirable to provide a patient identifying garment that provides one or more of these or other advantageous features, the teachings disclosed herein extend to those embodiments which fall within the scope of the appended claims, regardless of whether they accomplish one or more of the above-mentioned advantages.

DESCRIPTION

Figure 1:
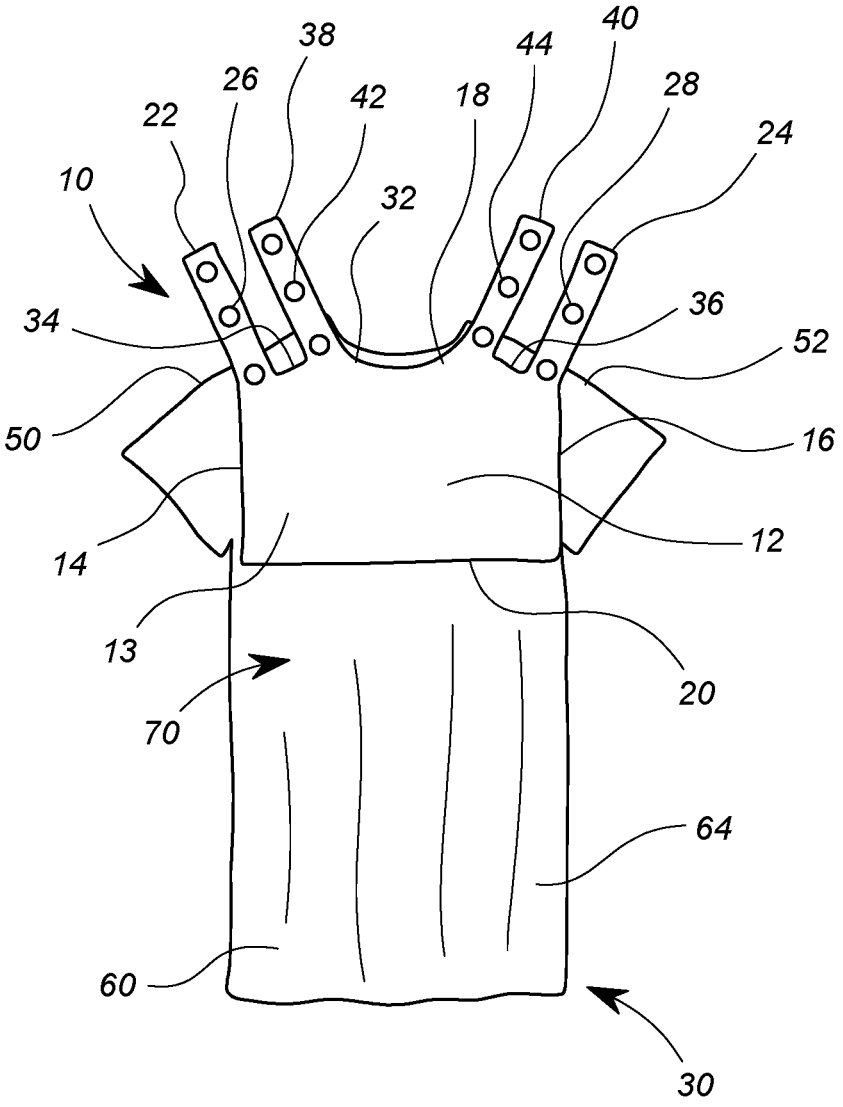
FIG. 1 shows a front view of an identifying garment as positioned on a front portion of a hospital gown prior to the identifying garment being secured to the hospital gown.

For the purposes of promoting an understanding of the principles of the invention, reference will now be made to the embodiment illustrated in the drawings and described in the following written description. It is understood that no limitation to the scope of the invention is thereby intended. It is further understood that the present invention includes any alterations and modifications to the illustrated embodiment and includes further applications of the principles of the invention as would normally occur to one skilled in the art to which this invention pertains.

With reference to FIG. 1, a identifying garment 10 is configured to be worn in association with a medical gown 30. The identifying garment 10 generally comprises a flexible sheet 12 providing a visible indicator 13 and at least two straps 22, 24. The straps 22, 24 allow the identifying garment 10 to be secured to fasteners 46, 48 on the hospital gown 30.

With continued reference to FIG. 1, the flexible sheet 12 of the identifying garment 10 is generally a panel of fabric such as a cotton or polyester material, but may also be provided in other forms, such as a panel of plastic material. The flexible sheet 12 has a first lateral edge 14, a second lateral edge 16, an upper edge 18 and a lower edge 20. The upper edge 18 may include a central concave edge portion 32 disposed between a first top edge portion 34 and a second top edge portion 36. The width of the flexible sheet 12 exceeds the diameter of an adult human neck. In at least one embodiment, the flexible sheet 12 may have a generally rectangular or trapezoidal shape. However, it will be recognized that the flexible sheet 12 may also be provided in other shapes and sizes different from that shown in FIG. 1. For example, the flexible sheet 12 may be generally triangular, circular, or other shaped. The thickness of the flexible sheet 12 is such that it conforms to the shape of the wearer, has little weight, and is comfortable to the wearer. The flexible sheet 12 is generally designed to allow the identifying garment to be worn with the wearer having little or no knowledge that he or she is wearing an additional garment other than the gown.

Figure 2:
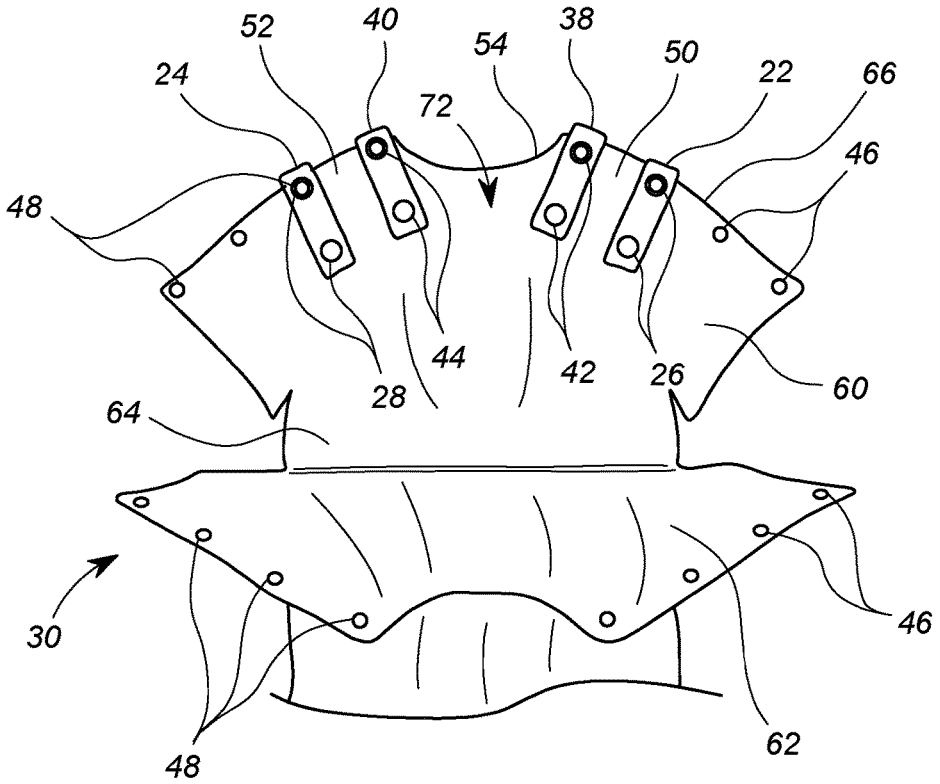
FIG. 2 shows a back view of the identifying garment of FIG. 1 with straps placed around the shoulder portions of a front panel of the hospital gown, the holes through said straps being aligned with snap fasteners of the hospital gown.

Referring now to FIG. 1 and FIG. 2, the identifying garment 10 further includes a first strap 22 and a second strap 24 extending upwards away from the upper edge 18 of the flexible sheet 12. The first strap 22 and the second strap 24 are generally elongated in shape having a greater length than width. In at least one embodiment the first strap 22 has a length between about three inches and about ten inches and a width between about a half inch and two inches. However, it will be recognized that straps of different sizes may also be used. The first strap 22 has at least one hole 26 therethrough and the second strap 24 has at least one hole 28 therethrough as well. As explained in further detail below, the at least one hole 26 on the first strap 22 is adapted to be secured between a plurality of snap fasteners 46 on a first shoulder portion 50 of a hospital gown 30. The at least one hole 28 on the second strap 24 is adapted to be secured between a plurality of snap fasteners 48 on a second shoulder portion 52 of the hospital gown 30. The first strap 22 is disposed on or adjacent to the first top edge portion 34 and the second strap 24 is disposed on or adjacent to the second top edge portion 36. Accordingly, the first strap 22 and the second strap 24 are spaced apart and oriented on the indentifying garment 10 such that the holes 26, 28 will align with the snap fasteners 46, 48 on the hospital gown 30.

The visible indicator of the identifying garment 10 is a color, pattern or other indicator provided on an exposed surface 11 of the flexible sheet 12. For example, in at least one embodiment, the visible indicator is a solid color covering the entire exposed surface, thus making the solid color easy to see and recognize by health providers. In at least one embodiment, the solid color on the exposed surface is yellow or another easily identifiable color. Because the exposed surface is relatively large (e.g., greater than the width of a human neck), the exposed surface 11 and associated indicia (e.g., a solid yellow color) is easy to identify. The shape of the flexible sheet 12 is generally rectangular and covers most of the chest of the patient wearing the identifying garment 10, but as noted above, the flexible sheet 12 may also be provided in other shapes and sizes.

The identifying garment 10 may further comprise a third strap 38 and a fourth strap 40. The third strap 38 and the fourth strap 40 are similar to the first strap 22 and the second strap 24 in size and in shape and extend upwards away from the upper portion 18 of the flexible sheet 12. The third strap 38 has at least one hole 42 therethrough and the fourth strap 40 has at least one hole 44 therethrough as well. The at least one hole 42 on the third strap 38 is adapted to be secured between the plurality of snap fasteners 46 on the first shoulder portion 50 of the hospital gown 30. The at least one hole 44 on the fourth strap 40 is adapted to be secured between the plurality of snap fasteners 48 on the second shoulder portion 52 of the hospital gown 30. The third strap 38 is disposed on or adjacent to the first top edge portion 34 and the fourth strap 40 is disposed on or adjacent to the second top edge portion 36. As noted above, the first strap 22, the second strap 24, the third strap 38 and the fourth strap 40 can have a plurality of holes therethrough. Accordingly, while FIGS. 1 and 2 show three holes through each of the straps 22, 24, 38 and 40, in other embodiments the straps may include a different number of holes (e.g., one, two, five, ten, etc.). Furthermore, it will be recognized that the straps 22, 24, 38 and 40 are spaced apart and oriented on the indentifying garment 10 such that the holes 26, 28, 42, 44 will align with the snap fasteners 46, 48 on the hospital gown 30 when the identifying garment 10 is used in association with a medical gown 30. Accordingly, differently spaced straps 22, 24, 38 and 40 may be required on the identifying garment 10 depending on the make and model of the hospital gown 30 to be used in association with the identifying garment 10.

With continued reference to FIGS. 1 and 2, a medical gown in the form of a hospital gown 30 includes a front side 60 and a rear side 62. The front side 60 is generally a panel of fabric material which includes a torso portion 64, the first shoulder portion 50, the second shoulder portion 52, and a neck 54. The panel of fabric material includes an exterior surface 70 (shown in FIG. 1) and an interior surface 72 (shown in FIG. 2). Fasteners are aligned along the top edge 66 of the front side 60. The fasteners include snap members 46 along the first shoulder portion 50 and snap members 48 along the second shoulder portion 52. In the embodiment disclosed in FIG. 2, four snap members 46 are shown on the first shoulder portion 50 of the front side 60 and four snap members 48 are shown on the second shoulder portion 52 of the front side.

The rear side 62 of the medical gown 30 is complimentary to the front side 60 and may be symmetrical to the front side 60 in shape. Accordingly, when the rear side 62 is paired to the front side 60, a gown that covers both the anterior and the posterior of the torso portion of the human body is formed. Fastener members 46, 48 are provided along the top edge of the rear side 62. These fastener members 46, 48 are complimentary to the fastener members 46, 48 provided along the top edge of the front side 60. Accordingly, if male snap members are provided on the front side 60 of the medical gown 30, female snap members are provided on the rear side 62, and vice-versa. When the snap members on the front side 60 are aligned with the snap members on the rear side 62, and the snap members are engaged, the complementary snap members remain engaged, thus securing the front side 60 to the rear side 62 such that a complete medical gown 30 is formed. The complete medical gown 30 is configured to hang from the body of the wearer without falling off the wearer. While the fastener members 46, 48 have been described herein as snap members, it will be recognized that in other embodiments any of various other types of fastener members (e.g., Velcro members) may be utilized on the medical gown 30.

In the embodiment disclosed herein, the identifying garment functions similarly to a conventional bib but with added features of heightened visibility indicating that the patient is a fall risk and straps that attach directly to the hospital gown as opposed to the straps fastening or adhering together behind the user's neck. The identifying garment can be placed on the user by lining up the holes on the straps with the snap fasteners on the hospital gown and then closing the snaps together to secure the straps in place. In the exemplary embodiment of FIG. 2, the middle hole on each of the straps 22, 24, 38, 40 is aligned with one of the snap members 46, 48. For example, the stud on the male snap member 46, 48 on the front side 60 of the medical gown 30 may be inserted through the associated hole 26, 28, 42, 44, and the stud then inserted into the female snap member 46, 48 on the rear side 62 of the medical gown 30. When the complementary snap members on the front side 60 and the rear side 62 of the medical gown are engaged, the straps 22, 24, 38, 40 are thereby trapped by the snap members, thus securing the identifying garment 10 to the user.

Figure 3:
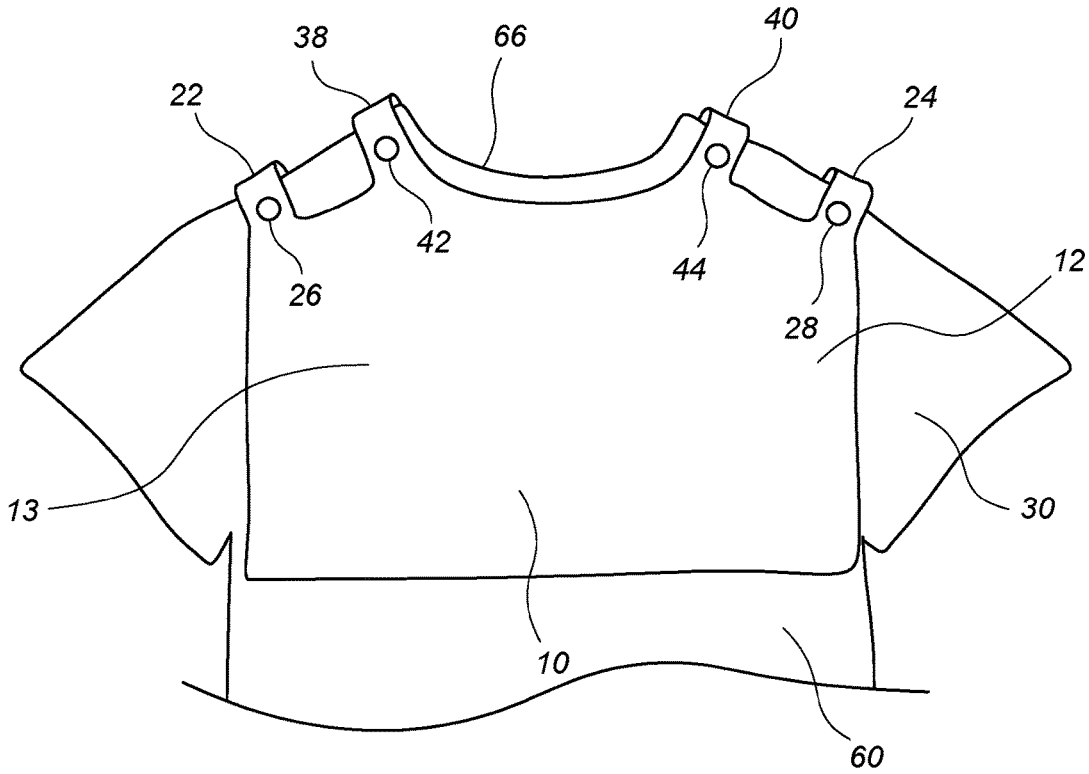
FIG. 3 shows a front perspective view of the identifying garment of FIG. 1 secured to the hospital gown.

FIG. 3 shows a front perspective view of the medical gown 30 with the identifying garment 10 secured to the front side 60 of the gown 30. The flexible sheet 12 is prominently positioned on the front of the gown 30 such that the visible indicator 13 may be easily seen by third parties. As shown in FIG. 3, the straps 22, 24, 38, 40 hook around the top edge 66 on front side 60 of the medical gown 30 and extend into the interior of the gown between the front side 60 and the rear side 62. One hole on each of the straps 22, 24, 38, 40 is secured to one of the fasteners 46, 48. However, other holes 26, 28, 42 and 44 on the straps are visible, as these holes were not used to secure the identifying garment 10 to the medical gown 30.

Figure 4:
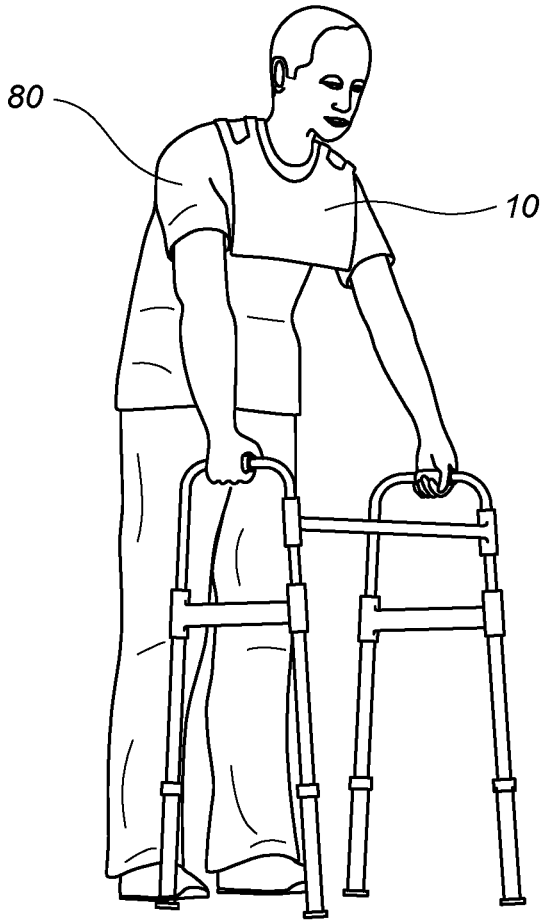
FIG. 4 shows a perspective view of a user wearing the identifying garment of FIG. 1.

As shown in FIG. 4, with the identifying garment 10 secured to a patient 80, the identifying garment 10 hangs down from the neck area towards his or her chest area, as shown in FIG. 4. This makes the visible indicator 13 on the flexible sheet easily visible to healthcare professionals, thus assisting the healthcare professionals in identifying the patient as having a designated or identified health condition, such as a patient being identified as a fall risk. The identifying garment 10 can be hung at varying heights if the straps 22, 24, 38, 40 have more than one hole. This means that the identifying garment is suitable for various user heights and sizes. Moreover, because of the manner in which the identifying garment 10 is secured to the patient via the medical gown, any attempted removal of the identifying garment by the patient is likely to cause the fastener members on the medical gown 30 to be disturbed and disengaged. Disengagement of the fastener members on the medical gown 30 will cause the gown to be disheveled or completely fall away from the patient. Accordingly, a disheveled or missing gown will alert the medical professionals entrusted with care of the patient that the patient has either attempted to remove or has successfully removed the identifying garment 10 without approval of the medical professionals.

Figure 5:
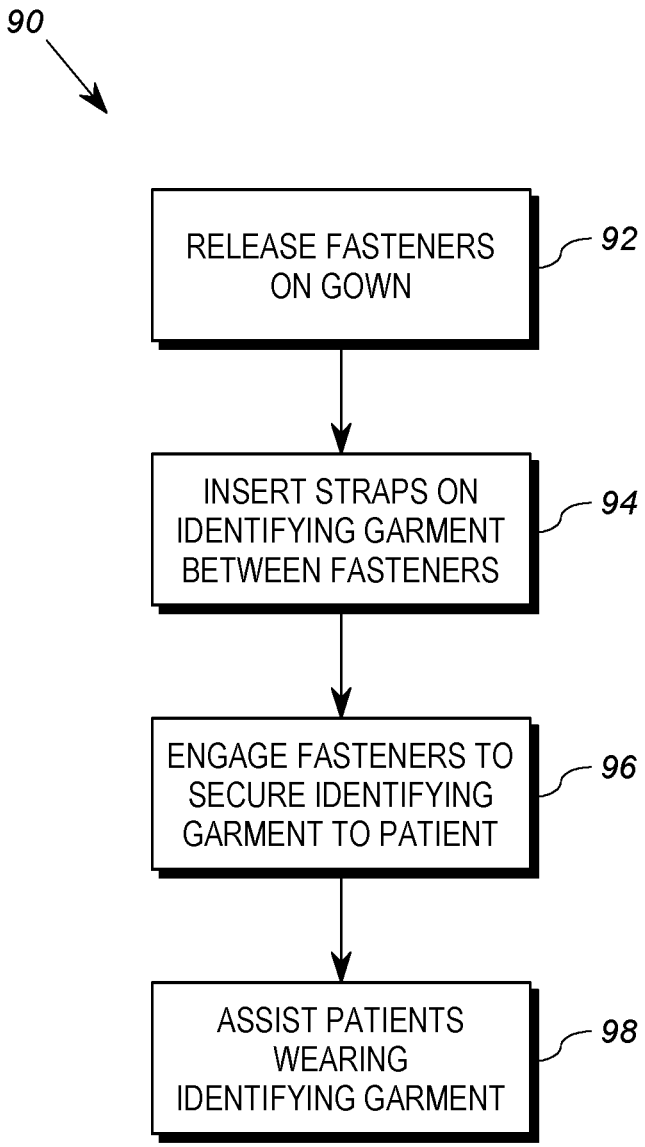
FIG. 5 shows a flowchart of a method of fitting a patient with an indentifying garment and assisting such patient.

With reference now to FIG. 5, a method of securing the above-described identifying garment 10 to a patient and monitoring such patient is described. First, as noted in step 92, the fastener members 46, 48 along the top edge 66 of the patient's medical gown 30 are released and separated from one another. Next, in step 94, the straps 22, 24, 38, 40 on the identifying garment 10 are inserted between the released fastener members 46, 48 on the medical gown 30. In particular, the holes 26, 28,42 and 44 on the straps 22, 24, 38, 40 of the identifying garment 10 are aligned with the snap members 46, 48 on the front side 60 of the medical gown 30 such that the studs of the snap members extend through the holes. Next, in step 96, the snap members 46, 48 on the rear side 62 of the medical gown 30 are then re-engaged with the complimentary snap members 46, 48 on the front side 60 of the medical gown 30 such that the straps 22, 24, 38, 40 are trapped between the snap members 46, 48. This secures the identifying garment 10 to the medical gown 30.

With the patient wearing the identifying garment 10, medical professionals in a medical facility (e.g., a hospital, rehabilitation center, nursing home, etc.) may quickly identify the patient as a fall risk and assist the patient, as noted in step 98 of FIG. 5. Accordingly, if such a patient wearing an identifying garment 10 is in bed, medical professionals will be alerted that the patient should have assistance before attempting to leave the bed. Additionally, if a patient wearing an identifying garment 10 is moving about the medical facility without assistance, any medical professional or staff member will be alerted that the roaming patient is a fall risk. In this manner roaming patients who are a fall risk will be more quickly provided with medical attention to assist them in avoiding a fall. Furthermore, as noted previously, if a patient with a disheveled gown is seen moving about the medical facility, the medical staff will be alerted that the patient may be a fall risk patient who has removed the identifying garment 10.

The foregoing detailed description of one or more exemplary embodiments of the patient identifying garment has been presented herein by way of example only and not limitation. It will be recognized that there are advantages to certain individual features and functions described herein that may be obtained without incorporating other features and functions described herein. For example, in the embodiment described herein, the identifying garment is visible only on the front side of the medical gown. In alternative embodiments, the identifying garment may include a front portion and a rear portion such that the identifying garment is visible from both the front side and the rear side of the patient wearing the garment. Moreover, it will be recognized that various alternatives, modifications, variations, or improvements of the above-disclosed exemplary embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the exemplary embodiments contained herein.

What is claimed is:

1. An identifying garment used in combination with a hospital gown, the hospital gown including a front side configured to cover a front torso of an adult human and a rear side configured to cover a rear torso of the adult human, the front side including a front top edge configured to extend from a first shoulder to a second shoulder of the adult human, and the rear side including a rear top edge configured to extend from the first shoulder to the second shoulder of the adult human, the front side including a plurality of first snap fasteners positioned along the front top edge and, the rear side including a plurality of second snap fasteners positioned along the rear top edge, the second snap fasteners complimentary to the first snap fasteners and configured to engage the first snap fasteners to form a left shoulder portion and a right shoulder portion on the hospital gown, the identifying garment further comprising:

a flexible sheet having a visible indicator, the flexible sheet having a first lateral edge, a second lateral edge, an upper portion and a lower portion, the flexible sheet having a width configured to exceed a diameter of an adult human neck; and first and second straps extending from said upper portion, each of said straps having at least one hole extending completely through a thickness of said strap, said at least one hole of the first strap receiving an engagement of one of the plurality of first snap fasteners with one of the plurality of second strap fasteners on the first shoulder portion of the hospital gown such that the first strap is secured on the first shoulder portion of the hospital gown with an end portion of the first strap positioned on an interior of the hospital gown, said at least one hole of the second strap receiving an engagement of one of the plurality of first snap fasteners with one of the plurality of the second snap fasteners on the second shoulder portion of the hospital gown such that the second strap is secured on the second shoulder portion of the hospital gown with an end portion of the second strap positioned on the interior of the hospital gown; and third and fourth straps extending from said upper portion, each of said third and fourth straps having at least one hole extending completely through a thickness of the strap, said at least one hole of the third strap receiving an engagement of the plurality of snap fasteners on the first shoulder portion of a hospital gown, said at least one hole of the fourth strap receiving to receive an engagement of the plurality of snap fasteners on the second shoulder portion of the hospital gown.

2. The identifying garment of claim 1, wherein said visible indicator is a uniform color completely covering an entire exposed surface of the flexible sheet.

3. The identifying garment of claim 2, wherein the uniform color is yellow.

4. The identifying garment of claim 1, wherein said flexible sheet is substantially rectangular in shape, and wherein the first lateral edge, the second lateral edge, and the lower portion of the flexible sheet are free from restraint on the front side of the hospital gown.

5. The identifying garment of claim 1, wherein the upper portion includes a central concave edge portion disposed between first and second top edge portions.

6. The identifying garment of claim 5, wherein the first strap is disposed on or adjacent to the first top edge portion, and the second strap is disposed on or adjacent to the second top edge portion.

7. The identifying garment of claim 1, the upper portion including a first top edge portion and a second top edge portion, wherein the third strap is disposed on or adjacent to the first top edge portion, and the fourth strap is disposed on or adjacent to the second top edge portion.

8. The identifying garment of claim 1, wherein the first, second, third and fourth straps include a plurality of holes therethrough.

9. A garment arrangement comprising:

a medical gown including a front side with a top portion and a rear side with a top portion, the front side including a front top edge configured to extend from a first shoulder to a second shoulder of an adult human, and the rear side including a rear top edge configured to extend from the first shoulder to the second shoulder of the adult human, the front side including a plurality of first fastener members positioned along the front top edge and, the rear side including a plurality of second fastener members positioned along the rear top edge, the second fastener members complimentary to the first faster members and engaging the first fastener members to form a left shoulder portion and a right shoulder portion on the medical gown; and an identifying garment including a plurality of straps attached to a panel providing a visible indicator, the plurality of straps engaging the first fastener members and the second fastener members such that the plurality of straps are positioned between the first fastener members and the second fastener members with ends of the plurality of straps extending to an interior of the medical gown and the panel of the identifying garment retained on an exterior of the medical gown, wherein the plurality of straps include a first strap, a second strap, a third strap and a fourth strap extending from an upper edge of said panel, each of said straps having at least one hole extending completely through a thickness of said strap, said at least one hole of the first and third straps being adapted to be secured between the first fastener members and the second fastener members on a first shoulder portion of the medical gown, said at least one hole of the second and fourth straps being adapted to be secured between the first fastener members and the second fastener members on the second shoulder portion of the medical gown.

10. The garment arrangement of claim 9 wherein said visible indicator is a uniform color covering an exposed surface of the panel.

11. The garment arrangement of claim 10, wherein the uniform color is yellow.

12. The garment arrangement of claim 9, wherein said panel is substantially rectangular in shape.

13. The garment arrangement of claim 9, wherein the panel includes a central concave edge portion disposed between a first top edge portion and a second top edge portion.

14. The garment arrangement of claim 9 wherein the plurality of first fastener members and the plurality of second fastener members are snap fasteners.

15. The identifying garment of claim 9, wherein each of the first, second, third and fourth straps include a plurality of holes extending completely through a thickness of said strap.

16. The identifying garment of claim 9 wherein the first fastener members or the second fastener members extend through the holes such that the plurality of straps engage first fastener members and the second fastener members via the holes, and the plurality of straps are secured to the medical gown by the engagement of the first fastener members and the second fastener members.

17. A method of identifying patients in a medical facility comprising:

releasing fasteners on a medical gown, the medical gown including a front side and a rear side, the front side including a front top edge configured to extend from a first shoulder to a second shoulder of an adult human with a plurality of first fastener members positioned along the front top edge of the medical gown, the rear side including a rear top edge configured to extend from the first shoulder to the second shoulder of the adult human with a plurality of second fastener members positioned along the rear top edge of the medical gown, the second fastener members complimentary to the first faster members and engaging the first fastener members;

inserting a plurality of straps on an identifying garment between the fasteners, the plurality of straps attached to a panel of the identifying garment providing a visible indicator, wherein the plurality of straps include a first strap, a second strap, a third strap and a fourth strap extending from an upper edge of said panel, each of said straps having at least one hole extending completely through a thickness of said strap, said at least one hole of the first and third straps being adapted to be secured between the first fastener members and the second fastener members on a first shoulder portion of the medical gown, said at least one hole of the second and fourth straps being adapted to be secured between the first fastener members and the second fastener members on the second shoulder portion of the medical gown; and engaging the fasteners on the medical gown with the plurality of straps on the identifying garment positioned therebetween such that the identifying garment is retained on the medical gown with the panel positioned on an exterior of the medical gown and a portion of each of the plurality of straps positioned on an interior of the medical gown.

18. The method of claim 17 wherein the fasteners are snap fasteners.

19. The method of claim 17 wherein said visible indicator is a uniform color covering an exposed surface of the panel.

20. The method of claim 19 wherein said uniform color is yellow and said panel is substantially rectangular in shape.

* * * * *